US009187216B2

(12) United States Patent
Jolly

(10) Patent No.: US 9,187,216 B2
(45) Date of Patent: Nov. 17, 2015

(54) NON-METALLIC WIRE-CAP CAPSULE FOR AN EFFERVESCENT BEVERAGE BOTTLE, AND ASSOCIATED CLOSURE SYSTEM

(71) Applicant: COMPTOIR COMMERCIAL CHAMPENOIS, Reims (FR)

(72) Inventor: Pierre Eric Jolly, Landreville (FR)

(73) Assignee: COMPTOIR COMMERCIAL CHAMPENOIS, Reims (FR)

( * ) Notice: Subject to any disclaimer, the term of this patent is extended or adjusted under 35 U.S.C. 154(b) by 0 days.

(21) Appl. No.: 14/390,223

(22) PCT Filed: Apr. 5, 2013

(86) PCT No.: PCT/FR2013/050748
§ 371 (c)(1),
(2) Date: Oct. 2, 2014

(87) PCT Pub. No.: WO2013/150249
PCT Pub. Date: Oct. 10, 2013

(65) Prior Publication Data

US 2015/0090687 A1 Apr. 2, 2015

(30) Foreign Application Priority Data

Apr. 5, 2012 (FR) ..... 12 53150

(51) Int. Cl.
*B65D 41/62* (2006.01)
*B65D 41/28* (2006.01)
*B65D 55/06* (2006.01)
*B65D 39/00* (2006.01)

(52) U.S. Cl.
CPC ..... *B65D 41/28* (2013.01); *B65D 39/0011* (2013.01); *B65D 41/62* (2013.01); *B65D 55/063* (2013.01)

(58) Field of Classification Search
CPC ..... B65D 41/34
USPC ..... 215/278, 291, 364, 230
See application file for complete search history.

(56) References Cited

U.S. PATENT DOCUMENTS

D599,660 S * 9/2009 Pieriboni ..... D9/435
8,517,193 B1 * 8/2013 Small ..... 215/206

FOREIGN PATENT DOCUMENTS

EP 1479617 A1 11/2004
FR 892325 A 4/1944
FR 1525663 A 10/1968
FR 2956385 A1 8/2011
WO WO2009007583 A3 1/2009

OTHER PUBLICATIONS

ISA/EP International Search Report issued Jun. 21, 2013 re PCT Application No. PCT/FR2013/050748, filed Apr. 5, 2013.

* cited by examiner

*Primary Examiner* — Anthony Stashick
*Assistant Examiner* — Raven Collins
(74) *Attorney, Agent, or Firm* — Patrick J. Daugherty; Driggs, Hogg, Daugherty & Del Zoppo Co., LPA

(57) ABSTRACT

The invention concerns a wire-cap capsule (1) intended to be interposed between a wire-cap (2) and a stopper intended to plug a neck of a bottle containing an effervescent liquid, said capsule comprising three grooves (10, 11, 12) provided on a first face to each accommodate a portion of a leg (20, 21, 22) of the wire-cap, said grooves meeting at the centre of the capsule to form a Y, characterised in that the capsule (1) is rigid, non-metallic, obtained by moulding and/or recyclable and optionally decorated. The capsule according to one preferred embodiment allows the cage of the wire-cap to be held by force by fastening at lugs (13). The invention also relates to a closure system comprising said capsule.

14 Claims, 2 Drawing Sheets

NON-METALLIC WIRE-CAP CAPSULE FOR AN EFFERVESCENT BEVERAGE BOTTLE, AND ASSOCIATED CLOSURE SYSTEM

TECHNICAL FIELD OF THE INVENTION

The present invention relates to a non-metal cap for muselets of bottles of Champagne and other effervescent beverages. The present invention also relates to systems for stoppering bottles, and to associated bottles.

In this technical field, it is known to stopper bottles containing an effervescent liquid using a stopper preferably made of cork, and to hold the stopper in place using a muselet, which generally consists of iron metal wires attached in the manner of a bridle, placed over the neck of the bottle. This ensures that the bottle stays sealed despite the force exerted by the pressure of the gas inside the bottle.

In order to prevent the muselet from digging too far into the stopper and for aesthetic reasons, it is known to insert a muselet cap between the cage of the muselet (wire) and the stopper.

Therefore, the muselet cage is connected to a cap which forms the interface with the stopper by being inserted between said stopper and the ring of the muselet. A cap of this type has the technical function of distributing the pressure forces and preventing the metal wire from becoming embedded in the stopper for example made of cork. From an aesthetic perspective, such a cap makes it possible to give the stoppering system a rounded shape.

PRIOR ART

The teachings of the current prior art propose muselet caps and bottle stoppering systems.

Therefore, FR 2 947 250 discloses a muselet plate which is preferably produced from metal material, for example from a sheet of galvanised metal which is preformed by stamping and assembled on the muselet by branches pinching in four smooth grooves. Alternatively, the muselet plate can be produced from synthetic material for example by moulding or thermoforming. This plate comprises arcuate grooves on the cap and grooves on the edge for accommodating twists of a muselet having four legs.

However, this muselet plate comprises four grooves and is part of a stoppering system comprising a muselet having four legs, thereby suggesting a long length of metal wire used, with twists of said wires in a plurality of locations.

The international application WO 2009/007583 also discloses a cap formed by a metal plate which comprises three grooves which meet at the centre of said plate and form a Y shape. The plate cooperates with a cage which comprises three legs which meet at the top of said cage in a Y shape. The muselets disclosed in this document have allowed a saving of metal wire of approximately 35% to 46%. The muselet cage described in this document is also held in place by simple pinching in smooth grooves.

However, the cap disclosed in this document is made of metal, which leads to difficulties in producing the grooves, and in controlling the depth thereof. In addition to being difficult to shape, the metal caps are very difficult to recycle. In addition, heating temperatures of approximately 1400° C. are required to produce metal caps. This represents a considerable energy cost. In addition, producing metal caps leads to problems which are like trying to square the circle in the sense that the spherical caps are cut into square pieces, thereby leading to waste (rejects, loss of material) of approximately 18.5 % by weight.

SUMMARY OF THE INVENTION

The aim of the invention is to remedy the drawbacks outlined above, and in particular to propose a system which is improved in relation to the prior art. In addition, the aim of the invention is to propose new muselet caps which are of aesthetic interest for placomusophilia.

In order to do this, a muselet cap is proposed which is intended to be inserted between a muselet and a stopper intended to seal a neck of a bottle containing an effervescent liquid, said cap comprising three grooves provided in a first face for each accommodating a portion of a muselet leg, said grooves meeting in the centre of the cap and forming a Y shape.

According to a first aspect of the invention, the cap is rigid, not made of metal, obtained by moulding and/or recyclable.

According to a preferred embodiment, the first face of the cap comprising the muselet is substantially smooth on the outside, the wire forming the muselet being accommodated completely in the grooves. Therefore, the first face of the cap has a substantially smooth curvature, following a uniform radius of curvature, which gives it a noteworthy aesthetic appearance.

Preferably, the cap is produced from a thermoformable material, preferably from homopolymer polypropylene. This type of material makes it possible to produce a cap having a marking by amalgamated plastics film.

According to a preferred variant, the cap is produced from a thermosetting material, preferably made of carbon fibres.

The cap according to the invention can be produced by any technique which can be adapted to the invention and using any other material. Therefore, according to an advantageous aspect, the cap can be produced from glass, preferably crystal, from plant fibres, from ceramic, from porcelain or from turned wood.

According to a preferred variant, at least one of the grooves comprises pins for longitudinally stabilising the leg portions.

According to an advantageous aspect of the invention, the cap cooperates with a muselet comprising at least one doubled, preferably twisted leg portion, and the pins of said cap are provided in the groove accommodating said doubled, twisted leg portion. Doubled leg portion is understood to mean a region formed by wires brought together by a means of connection preferably selected from a wire twist, and a weld.

Advantageously, the cap further comprises at least one engraved or moulded inscription on said first face. In the case of an engraved or moulded inscription, the first face is smooth except for said inscriptions.

Advantageously, the cap comprises at least a protuberance on a second face which is intended to be in contact with said stopper, said protuberance being intended to enhance the rigidity of the cap.

According to an advantageous variant, the cap further comprises at least one stabilising tooth on the second face of the cap in contact with the stopper.

The invention also relates to a stoppering system for a bottle containing an effervescent liquid, comprising:

- a stopper preferably made of cork,
- a muselet cap such as described above, and
- a Y-shaped muselet cooperating with said cap and the stopper in order to hermetically seal said bottle.

The invention also relates to a bottle containing an effervescent liquid comprising a stoppering system such as described above.

BRIEF DESCRIPTION OF THE DRAWINGS

Other features, details and advantages of the invention will become apparent upon reading the following description with reference to the accompanying drawings, in which.

For the sake of clarity, same or like elements are given the same reference signs in all of the drawings.

DETAILED DESCRIPTION OF THE EMBODIMENTS

Figure 1:
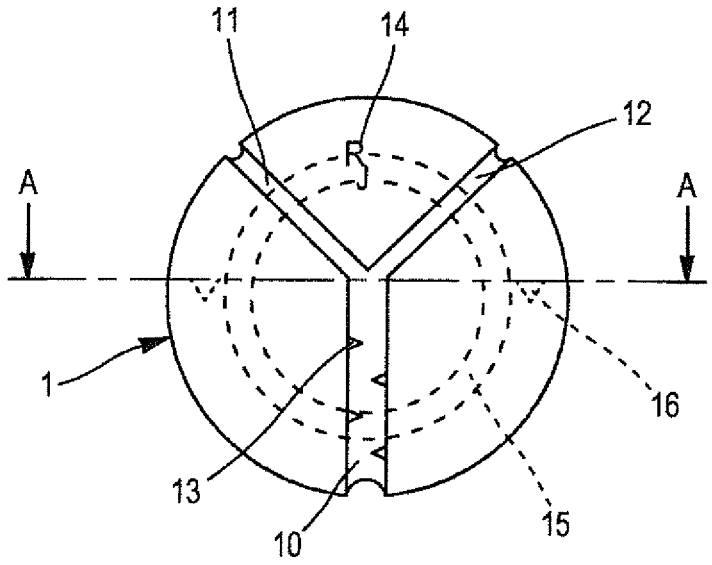
FIG. 1 is a plan view of a muselet cap according to a preferred variant of the invention at a first face referred to as the upper face.

With reference to FIG. 1, the cap 1 according to a first preferred variant of the invention is similar to that in WO 2009/007583, but it is produced from a thermoplastic material. It further comprises reinforcements and stabilising means. This cap is preferably produced from homopolymer polypropylene.

The cap 1 comprises a convex first face (or upper face) which cooperates directly with a muselet 2, and a concave inner face (or lower face) in contact with a stopper for example made of cork (not shown).

Therefore, the cap 1 comprises three open grooves 10,11, 12 on its outer face (or upper face) each receiving a portion of the legs of a muselet 2. One of the grooves 10 is slightly wider than the other two and receives a doubled, preferably twisted leg of the muselet 2. The outer face (or upper face) of the cap is completely smooth except for engraved or moulded inscriptions 14. The engraved or moulded inscriptions are not compulsory within the meaning of the invention. When they are present, the outer face is said to be a marked outer face.

The cap 1 can be produced by moulding (plastics injection moulding) instead of stamping metal sheets. This makes it possible to produce inscriptions 14 and/or pins 13 keeping the leg accommodated in one of the grooves 10. In a variant, the inscriptions can be produced by engraving the outer surface of the plastics material. These inscriptions make it possible to include for example an advertisement, a brand, contact details, a standard, etc. Therefore this feature has a practical and/or aesthetic advantage which is visible to the consumer who opens the bottle. In addition, as a result of its aesthetic appearance, some consumers may collect such caps (placomusophiles).

In a variant, a marking by amalgamated plastics film can be used. Therefore a marked plastics film is integrated in the cap and merges with said cap when the plastics injection moulding takes place. Surprisingly, the applicant has discovered that this type of method conventionally used in the production of ice boxes can be adapted to the production of muselet caps with surprising aesthetic effects. In addition it is of great interest for placomusophilia.

In addition it is possible to choose the depth of the grooves such that the leg portions can be accommodated integrally in the grooves. The pins 13 are preferably provided in one of the grooves 10, but they may also be present in two or even three grooves 11,12.

Figure 2A:
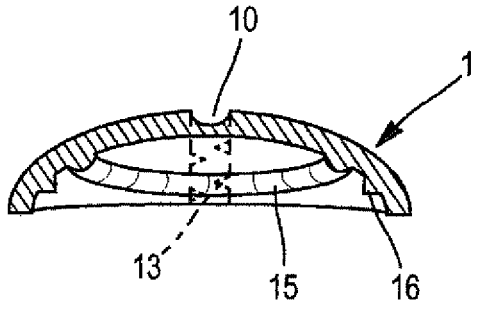
FIG. 2A is a sectional view along AA of the cap in FIG. 1.
Figure 2B:
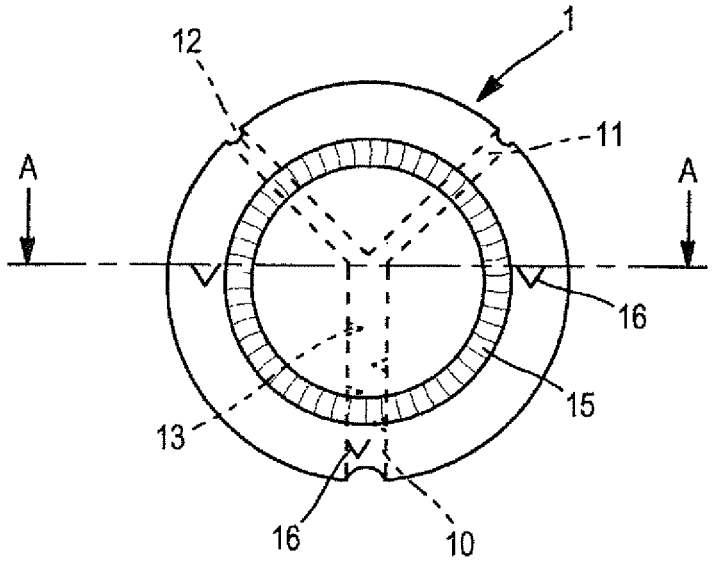
FIG. 2B is a view from below of the cap in FIG. 1.

With reference to FIG. 2A and 2B, the cap according to the first preferred variant comprises at least one protuberance 15 on its inner face which makes it possible to enhance its rigidity. The protuberance 15 also makes it possible to distribute the pressure forces from the stopper on the muselet, through the cap 1. In this case, the protuberance 15 consists of a positive relief in the form of a ring. Different types of reliefs in various forms can also be envisaged without departing from the scope of the invention. For example one or more spherical elements can be provided as a protuberance, as shown in FIG. 2B.

In addition, the inner face of the cap 1 can be provided with stabilising teeth 16 which dig into the cork stopper.

Figure 2C:
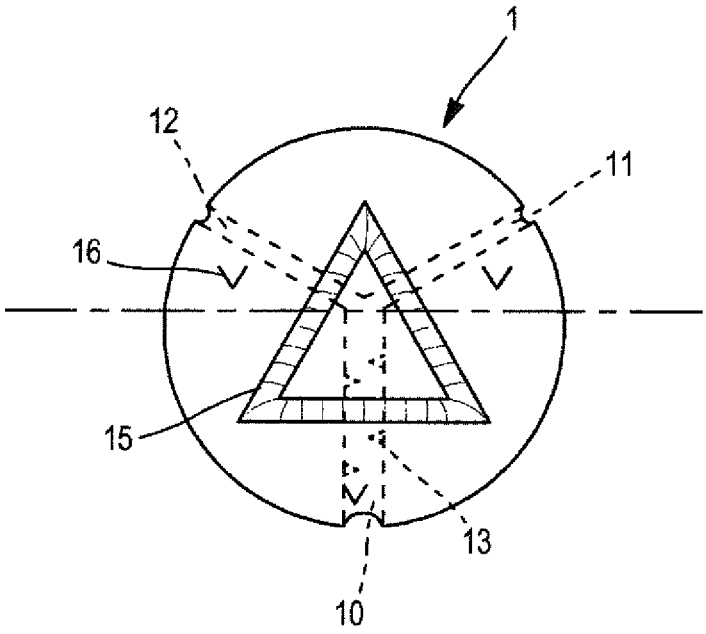
FIG. 2C is a view from below of the cap according to another variant of the invention.

With reference to FIG. 2C, the cap according to another preferred variant comprises a protuberance 15 which consists of a triangular positive relief. Apart from the shape of the protuberance 15, the other features are the same as those in the variant shown in FIG. 1 to 2B.

Figure 3:
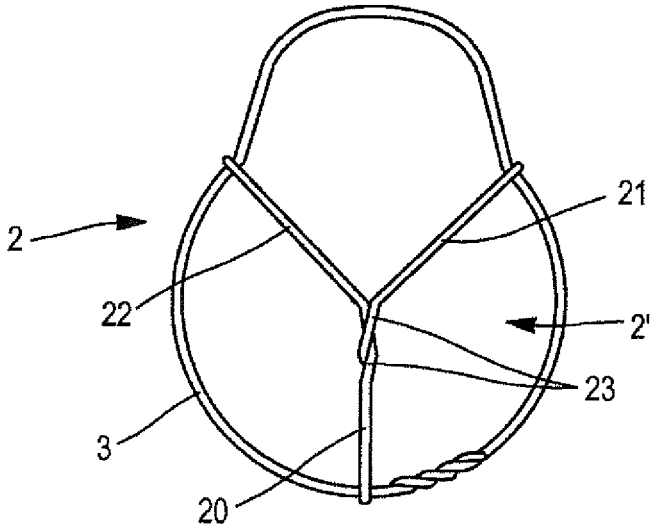
FIG. 3 is a plan view of a muselet which is capable of cooperating with the cap in FIG. 1 to 2C.

With reference to FIG. 3, the muselet 2 which cooperates with the cap 1 is a muselet according to WO 2009/007583. As can be seen in FIG. 3, the muselet 2 comprises a cage 2' and a belt 3 produced from metal wires. The cage 2' is intended to be connected to the cap in FIG. 1 and 2 and comprises three legs 20, 21 and 22 which meet at the top thereof to form a Y shape. The belt 3 may be shorter than that of known muselets; it surrounds the neck of the bottle and comes to bear under the throat of the neck.

In order to assemble the three legs 20, 21 and 22, a means of connection is created between the wires consisting for example of two twisted wires 23 to form a muselet having three legs. An assembly by welding can also be envisaged without departing from the scope of the invention.

The regions of the twisted wire 23 are intended to cooperate with the pins 13 of the cap 1 in order to longitudinally stabilise and block or clip a leg 20 in one of the grooves, preferably in the widest groove 10.

With regard to the materials used for producing the cap, homopolymer polypropylene is preferred due to its physicochemical properties, and in particular its low melting temperature (approximately 200° C.). Therefore it is easy to melt the caps for example in order to recycle them. This allows an energy saving of up to approximately 86%. In addition, according to tests, homopolymer polypropylene has a rigidity which is sufficient for the cap whilst also allowing few restrictions with respect to recycling. Therefore the caps can easily be ground down and re-injected into a recycling circuit.

The cap according to the first variant is produced using plastics injection moulding. The mould for producing the cap is preferably modular and the portion corresponding to the upper face can be personalised according to the client's wishes. The cap is personalised by means of the colours of the cap and/or the moulded or engraved inscriptions and/or the amalgamated plastics film-type markings or any other type of printed decoration.

The caps comprising at least one protuberance 15 on their inner face have demonstrated a greater capacity for modular injection, from the point of view of the stability of the parts. These protuberances also make it possible for these caps to be ejected more easily during the production thereof.

According to a second variant, the cap according to the invention is produced from a thermosetting material, preferably from carbon fibres. The cap according to this variant can for example be moulded and is easier to shape than a metal cap. Therefore, the caps are moulded, compressed, heated, then polished by hand.

The aesthetic appearance of the carbon fibre caps is also of interest for collectors.

In addition, the carbon caps have a low thickness, thereby placing fewer constraints on the stopper.

According to a third variant, the cap according to the invention is produced from plant fibres. This third variant is of interest in ecological terms and in terms of sustainable development. A person skilled in the art could adapt the known technologies to the production of this third variant.

Many combinations of materials can be envisaged without departing from the scope of the invention; a person skilled in the art would choose one or the other on the basis of the economic, ergonomic, size-related or other constraints that must be complied with.

The invention claimed is:

1. A Muselet cap intended to be inserted between a muselet and a stopper intended to seal a neck of a bottle containing an effervescent liquid, said cap comprising:

three grooves provided on a first face for each accommodating a portion of a muselet leg, said grooves meeting at a center of a cap and forming a Y shape; and at least one of the grooves comprising pins for longitudinally stabilizing the portion of the muselet leg; and wherein the cap is at least one of rigid, not made of metal, obtained by moulding and recyclable, and is produced from a material selected from homopolymer polypropylene, carbon fibers, glass, crystal, plant fibers, ceramic, porcelain or turned wood.

2. The Muselet cap according to claim 1, wherein a first face of the cap formed for receiving the muselet is substantially smooth on an outside surface; and wherein a wire forming the muselet is completely accommodated in the grooves.

3. The Muselet cap according to claim 1, further comprising:

a marking by an amalgamated plastics film.

4. The Muselet cap according to claim 1, which cooperates with a muselet comprising at least one twisted leg portion, wherein the pins are provided in the groove which accommodates said twisted leg portion.

5. The Muselet cap according to claim 1, further comprising:

at least one inscription which is engraved or moulded on said first face.

6. A Muselet cap intended to be inserted between a muselet and a stopper intended to seal a neck of a bottle containing an effervescent liquid, said cap comprising:

three grooves provided on first face for each accommodating a portion of a muselet leg, said grooves meeting at a center of a cap and forming a Y shape; and at least one protuberance on a second face which is intended to be in contact with a stopper intended to seal a neck of a bottle containing an effervescent liquid, said protuberance being intended to enhance the rigidity of the cap; and wherein the cap is at least one of rigid, not made of metal, obtained by moulding and recyclable, and is produced from a material selected from homopolymer polypropylene, carbon fibers, glass, crystal, plant fibers, ceramic, porcelain or turned wood.

7. The Muselet cap according to claim 6, further comprising:

at least one stabilizing tooth on a second face of the cap that is in contact with the stopper.

8. The Muselet cap according to claim 6, wherein a first face of the cap formed for receiving the muselet is substantially smooth on an outside surface; and wherein a wire forming the muselet is completely accommodated in the grooves.

9. The Muselet cap according to claim 6, further comprising:

a marking by an amalgamated plastics film.

10. The Muselet cap according to claim 6, further comprising:

at least one inscription which is engraved or moulded on said first face.

11. A Stoppering system for a bottle containing an effervescent liquid, the system comprising:

a stopper;

a muselet cap comprising three grooves provided on a first face for each accommodating a portion of a muselet leg, said grooves meeting at a center of the cap and forming a Y shape;

at least one of the grooves comprising pins for longitudinally stabilizing the portion of the muselet leg; and a Y-shaped muselet which cooperates with said cap and the stopper in order to hermetically seal said bottle; and wherein the cap is at least one of rigid, not made of metal, obtained by moulding and recyclable, and is produced from a material selected from homopolymer polypropylene, carbon fibers, glass, crystal, plant fibers, ceramic, porcelain or turned wood.

12. The Stoppering system of claim 11, wherein the stopper is made of cork.

13. A Stoppering system for a bottle containing an effervescent liquid, the system comprising:

a stopper;

a muselet cap comprising three grooves provided on a first face for each accommodating a portion of a muselet leg, said grooves meeting at a center of the cap and forming a Y shape;

at least one protuberance on a second face which is intended to be in contact with the stopper and intended to seal a neck of a bottle containing an effervescent liquid, said protuberance being intended to enhance the rigidity of the cap; and a Y-shaped muselet which cooperates with said cap and the stopper in order to hermetically seal said bottle; and wherein the cap is at least one of rigid, not made of metal, obtained by moulding and recyclable, and is produced from a material selected from homopolymer polypropylene, carbon fibers, glass, crystal, plant fibers, ceramic, porcelain or turned wood.

14. The Stoppering system of claim 13, wherein the stopper is made of cork.

* * * * *